US010583462B2

(12) United States Patent
Torashima et al.

(10) Patent No.: US 10,583,462 B2
(45) Date of Patent: Mar. 10, 2020

(54) ELECTROMECHANICAL TRANSDUCER AND METHOD OF PRODUCING THE SAME

(71) Applicant: CANON KABUSHIKI KAISHA, Tokyo (JP)

(72) Inventors: Kazutoshi Torashima, Yokohama (JP); Takahiro Akiyama, Atsugi (JP); Toshio Tomiyoshi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 211 days.

(21) Appl. No.: 15/660,813

(22) Filed: Jul. 26, 2017

(65) Prior Publication Data

US 2017/0333945 A1 Nov. 23, 2017

Related U.S. Application Data

(62) Division of application No. 13/434,405, filed on Mar. 29, 2012, now abandoned.

(30) Foreign Application Priority Data

Apr. 6, 2011 (JP) ..... 2011-084674

(51) Int. Cl.
*B06B 1/02* (2006.01)

(52) U.S. Cl.
CPC ..... *B06B 1/0292* (2013.01)

(58) Field of Classification Search
CPC ..... B06B 1/02; B06B 1/0292; H02N 11/00; A61B 8/44; A61B 8/4494; H01L 21/76898; H01L 23/481; H01L 23/5226; H04R 1/00; H04R 19/00; H04R 19/005; H04R 31/00
See application file for complete search history.

(56) References Cited

U.S. PATENT DOCUMENTS

2002/0093038 A1 7/2002 Ikeda et al.
2003/0015040 A1 1/2003 Ishio et al.
2003/0215974 A1 11/2003 Kawasaki
2005/0177045 A1 8/2005 Degertekin
2006/0179640 A1 8/2006 Machida
(Continued)

FOREIGN PATENT DOCUMENTS

CN 1883822 A 12/2006
CN 1883822 A 12/2006
(Continued)

OTHER PUBLICATIONS

D. Memmi, V. et al. ; "Fabrication of Capacitive Micromechanical Ultrasonic Tranducers by Low-Temperature Process;" 2002 Elsevier Science B.V.; XP002587610; pp. 85-91.

*Primary Examiner* — Tran N Nguyen
(74) *Attorney, Agent, or Firm* — Canon U.S.A., Inc. IP Division

(57) ABSTRACT

A method of producing an electromechanical transducer includes forming an insulating film on a first electrode, forming a sacrificial layer on the insulating film, forming a first membrane on the sacrificial layer, forming a second electrode on the first membrane, forming an etching-hole in the first membrane and removing the sacrificial layer through the etching-hole, and forming a second membrane on the second electrode, and sealing the etching-hole. Forming the second membrane and sealing the etching-hole are performed in one operation.

10 Claims, 4 Drawing Sheets

(56) References Cited

U.S. PATENT DOCUMENTS

| | | | | |
|---|---|---|---|---|
| 2009/0322181 | A1* | 12/2009 | Machida | B06B 1/0292 310/300 |
| 2010/0327380 | A1 | 12/2010 | Chang | |
| 2011/0026367 | A1 | 2/2011 | Noelle | |

FOREIGN PATENT DOCUMENTS

| | | | |
|---|---|---|---|
| CN | 101262958 | A | 9/2008 |
| CN | 101645484 | A | 2/2010 |
| EP | 2135685 | A1 | 12/2009 |
| EP | 1382565 | B1 | 12/2010 |
| JP | S64-013773 | A | 1/1989 |
| JP | 2003-500955 | A | 1/2003 |
| JP | 2003-332587 | A | 11/2003 |
| JP | 2006-122188 | A | 5/2006 |
| JP | 2007-527285 | A | 9/2007 |
| JP | 2007-528153 | A | 10/2007 |
| JP | 2008-288813 | A | 11/2008 |
| JP | 2009-296569 | A | 12/2009 |
| JP | 2010-154734 | A | 7/2010 |
| KR | 10-2004-0073227 | A | 8/2004 |
| KR | 10-2010-0121433 | A | 11/2010 |

* cited by examiner

ELECTROMECHANICAL TRANSDUCER AND METHOD OF PRODUCING THE SAME

CROSS-REFERENCE TO RELATED APPLICATION

This application is a Divisional of U.S. application Ser. No. 13/434,405, filed Mar. 29, 2012, which claims priority from Japanese Patent Application No. 2011-084674 filed Apr. 6, 2011, which are hereby incorporated by reference herein in their entireties.

BACKGROUND OF THE INVENTION

Field of the Invention

One disclosed aspect of the embodiments relates to an electromechanical transducer and a method of producing the transducer. More specifically, the embodiments relate to an electromechanical transducer that is used as an ultrasonic transducer.

Description of the Related Art

Electromechanical transducers such as a capacitive micromachined ultrasonic transducer (CMUT) produced by micromachining technology have been being researched as substitutes for piezoelectric devices. These capacitive electromechanical transducers may receive and transmit ultrasonic waves with vibration of vibration films.

A method where a cavity is formed by etching a sacrificial layer is known as a method of producing an electromechanical transducer, a CMUT. In the method described in U.S. Patent Publication No. 2005/0177045, in order to prevent an upper electrode (second electrode) from being etched during the etching of the sacrificial layer, a second electrode is disposed between a first membrane and a second membrane, and the sacrificial layer is etched.

The electromechanical transducer such as a CMUT is occasionally used in water, and therefore the cavity is sealed. That is, the cavity is formed by etching of a sacrificial layer, and then the etching-hole is sealed. In the method described in U.S. Patent Publication No. 2005/0177045, the second membrane is formed after formation of the second electrode, and then the sacrificial layer is etched. Subsequently, the etching-hole is sealed by a sealing film. In the case of forming a film for sealing the etching-hole as in the method described in U.S. Patent Publication No. 2005/0177045, the sealing film also deposits on the second membrane. Removal of the sealing film deposited on the second membrane by, for example, etching causes variations in thickness and stress of the vibration film, which may cause variations among the elements in sensitivity and bandwidth of the electromechanical transducer.

SUMMARY OF THE INVENTION

In the embodiments, the variations in thickness and stress among vibration films may be reduced.

The method of producing an electromechanical transducer according to aspects of the embodiments includes forming an insulating film on a first electrode; forming a sacrificial layer on the insulating film; forming a first membrane on the sacrificial layer; forming a second electrode on the first membrane; forming an etching-hole in the first membrane and removing the sacrificial layer through the etching-hole; forming a second membrane on the second electrode; and sealing the etching-hole. Forming the second membrane and sealing the etching-hole are performed in one operation.

The electromechanical transducer according to aspects of one embodiment includes a first electrode; an insulating film disposed on the first electrode; and a vibration film including a first membrane disposed on the insulating film with a space therebetween, a second electrode disposed on the first membrane so as to oppose the first electrode, and a second membrane disposed on the second electrode on the opposite side of the space. The space is formed by removing a sacrificial layer disposed on the insulating film through the etching-hole formed in the first membrane layer. The thickness of the sealing portion sealing the etching-hole is the same as the thickness of the second membrane on the second electrode.

According to one embodiment, the variations in thickness and stress of vibration films may be reduced, and thereby the variations among the elements in sensitivity and bandwidth of the electromechanical transducer may be reduced.

Further features of the embodiments will become apparent from the following description of exemplary embodiments with reference to the attached drawings.

DESCRIPTION OF THE EMBODIMENTS

An embodiment will now be described with reference to the drawings.

Configuration of Electromechanical Transducer

Figure 1A:
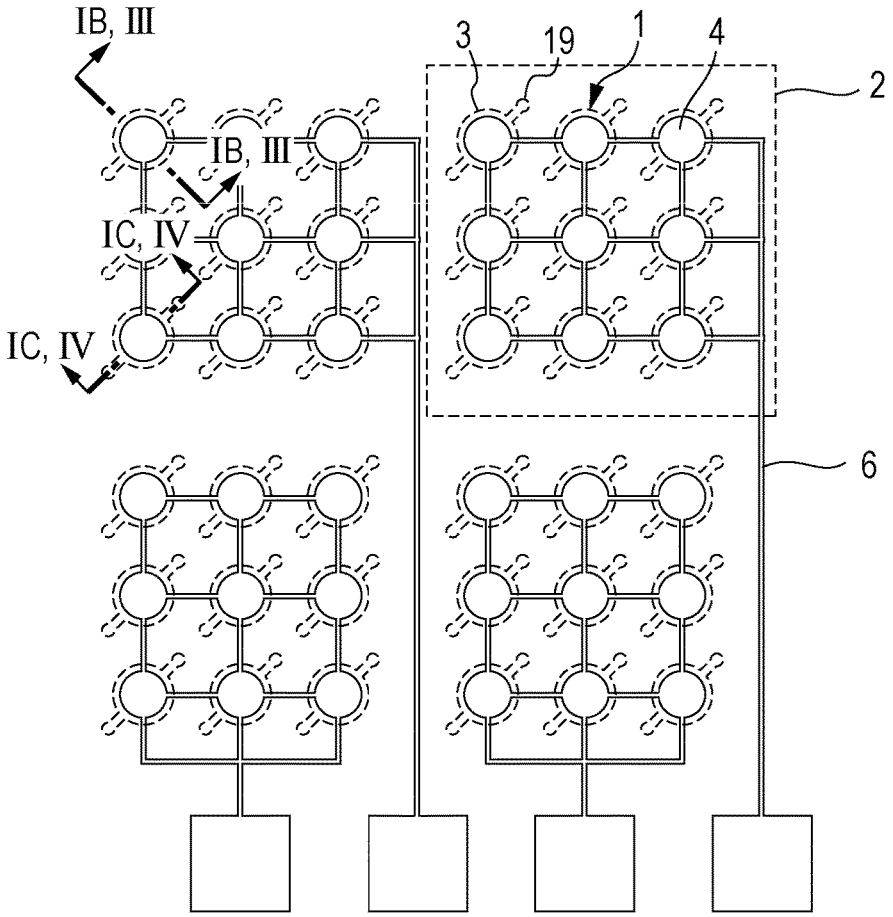
FIGS. 1A to 1C are schematic diagrams illustrating an electromechanical transducer to which Example 1 according to aspects of one embodiment may be applied.
Figure 1B:
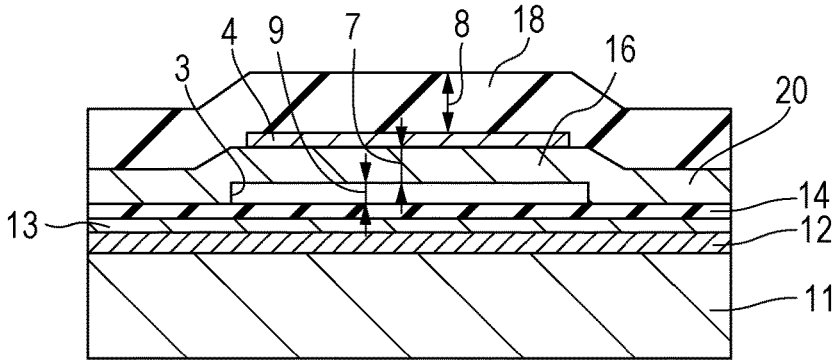
Figure 1C:
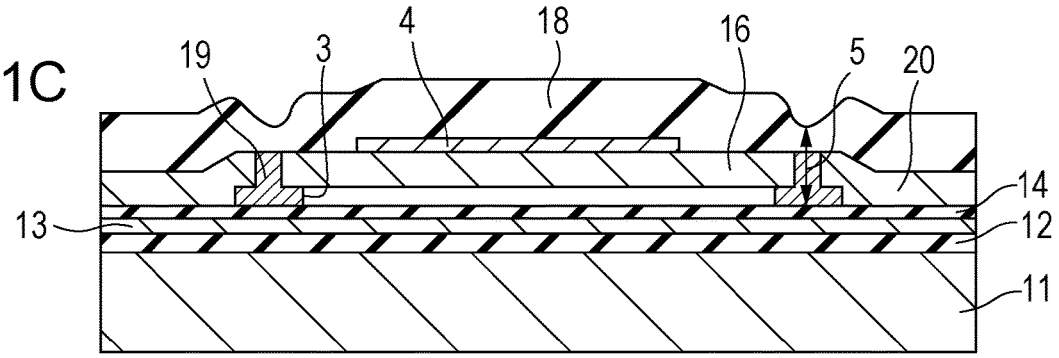

FIG. 1A is a top view of an electromechanical transducer according to aspects of one embodiment, and FIGS. 1B and 1C are cross-sectional views taken along lines IB-IB and IC-IC, respectively, of FIG. 1A. The electromechanical transducer of the embodiments includes a plurality of elements 2 each composed of a plurality of cell structures 1 that are electrically connected to one another. In FIG. 1A, each element 2 is composed of nine cell structures, but the number of the cell structures is not particularly limited. The electromechanical transducer shown in FIG. 1A has four elements, but the number of the elements is not particularly limited. The cell structures 1 shown in FIG. 1A are circular, but they may be, for example, square or hexagonal.

The cell structure 1 includes a substrate 11, a first insulating film 12 disposed on the substrate 11, a first electrode 13 disposed on the first insulating film 12, and a second insulating film 14 disposed on the first electrode 13. The cell structure 1 further includes a vibration film composed of a first membrane 16, a second membrane 18, and a second electrode 4. The first membrane 16 and the second membrane 18 are insulating films. The first insulating film 16 is supported by a membrane-supporting portion 20. The vibration film is arranged on the second insulating film 14 with a space, a cavity 3, therebetween. The first electrode 13 and the second electrode 4 oppose to each other, and a voltage is applied between the first electrode 13 and the second electrode 4 with a voltage-applying unit (not shown).

The electromechanical transducer may extract an electrical signal from the second electrode 4 of each element separately by using lead wiring 6. Though the lead wiring 6 is used for extracting the electrical signal in this embodiment, for example, through-wiring may be used. In this embodiment, the first electrode 13 is used as a common electrode, and the second electrode 4 is disposed to each element to extract the electrical signal from the second electrode 4 of each element. The configuration may be reversed such that the second electrode 4 is used as a common electrode, and the first electrode 13 is disposed to each element to extract the electrical signal of each element.

Drive Principle of Electromechanical Transducer

The drive principle of an electromechanical transducer according to aspects of one embodiment will be described. In the case of receiving ultrasonic waves by the electromechanical transducer, a voltage-applying unit (not shown) applies a DC voltage to the first electrode 13 so as to cause a potential difference between the first electrode 13 and the second electrode 4. Reception of ultrasonic waves bends the vibration film having the second electrode 4 to change the distance between the second electrode 4 and the first electrode 13 (the distance in the depth direction of the cavity 3), resulting in a change in capacitance. This change in capacitance causes a flow of an electric current in the lead wiring 6. This current is converted into a voltage by a current-voltage conversion device (not shown) to give an input signal of the ultrasonic waves. As described above, the configuration of the lead wiring may be changed so that a DC voltage is applied to the second electrode 4 and that an electrical signal is extracted from the first electrode 13 of each element.

In the case of transmitting ultrasonic waves, a DC voltage and an AC voltage are applied to the first electrode 13 and the second electrode 4, respectively, and the electrostatic force vibrates the vibration film. This vibration transmits ultrasonic waves. In also the case of transmitting ultrasonic waves, the configuration of the lead wiring 6 may be changed so that a DC voltage is applied to the second electrode 4 and an Ac voltage is applied to the first electrode 13 to vibrate the vibration film. Alternatively, a DC voltage and an AC voltage may be applied to the first electrode 13 or the second electrode 4 to vibrate the vibration film by electrostatic force.

Method of Producing Electromechanical Transducer

The method of producing an electromechanical transducer according to aspects of the present invention will be described with reference to FIGS. 3A to 3G and 4A to 4G. FIGS. 3A to 3G are cross-sectional views of an electromechanical transducer having approximately the same configuration as that shown in FIGS. 1A to 1C. FIGS. 3A to 3G are cross-sectional views taken along line III-III of FIG. 1A, and FIGS. 4A to 4G are cross-sectional views taken along line IV-IV of FIG. 1A.

Figure 3A:
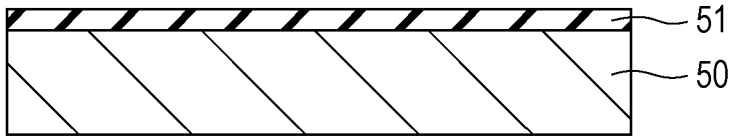
FIGS. 3A to 3G are cross-sectional views taken along line III-III of FIG. 1A for illustrating the method of producing an electromechanical transducer to which Example 1 of one embodiment may be applied.
Figure 4A:
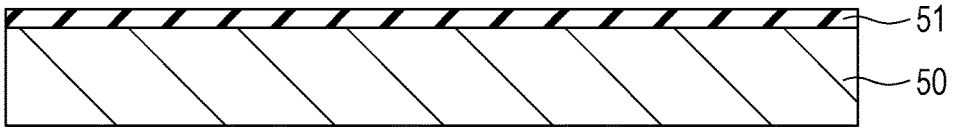
FIGS. 4A to 4G are cross-sectional views taken along line IV-IV of FIG. 1A for illustrating the electromechanical transducer to which Example 1 of one embodiment may be applied.

As shown in FIGS. 3A and 4A, a first insulating film 51 is formed on a substrate 50. In the case where the substrate 50 is an electrically conductive substrate such as a silicon substrate, the first insulating film 51 is formed for insulating the first electrode. In the case where the substrate 50 is an insulating substrate such as a glass substrate, the first insulating film 51 may not be formed. The substrate 50 should be a substrate having a low surface roughness. If the surface roughness is high, the surface roughness affects the formation of films in the steps posterior to this step, and the distance between the first electrode and the second electrode varies among the cells or the elements. This variation causes a variation in conversion efficiency, which causes variations in sensitivity and bandwidth. Accordingly, the substrate 50 should be a substrate having a low surface roughness.

Figure 3B:
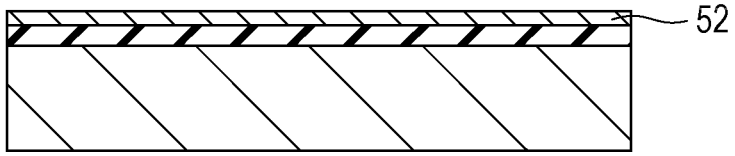
Figure 4B:
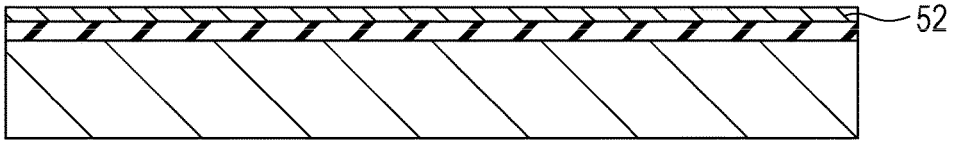

Subsequently, as shown in FIGS. 3B and 4B, a first electrode 52 is formed. The first electrode 52 may be made of an electrically conductive material having a low surface roughness, for example, titanium or aluminum. As in the substrate 50, if the surface roughness of the first electrode 52 is high, the distance between the first electrode and the second electrode due to the surface roughness varies among the cells or the elements. Accordingly, the first electrode 52 should be made of an electrically conductive material having a low surface roughness.

Figure 3C:
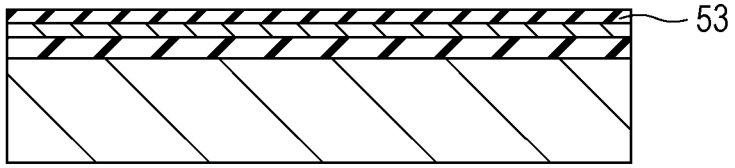
Figure 4C:
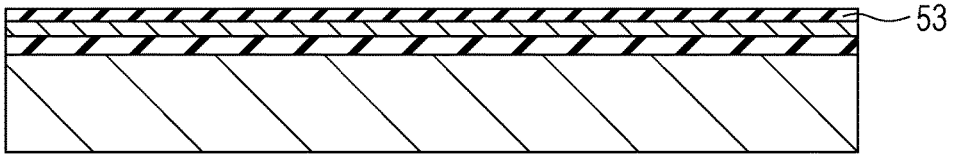

Subsequently, as shown in FIGS. 3C and 4C, a second insulating film 53 is formed. The second insulating film 53 is required to have a low surface roughness. The second insulating film 53 is formed for preventing electrical short between the first electrode 52 and the second electrode 56 or breakdown when a voltage is applied between the electrodes. In the case of driving at a low voltage, the second insulating film 53 may not be formed because that the first membrane 55 is an insulator. If the second insulating film 53 has a high surface roughness, the distance between the electrodes due to the surface roughness varies among the cells or the elements, as in the substrate 50. Accordingly, the second insulating film should be made of a material having a low surface roughness. For example, the second insulating film 53 is a silicon nitride film or a silicon oxide film.

Figure 3D:
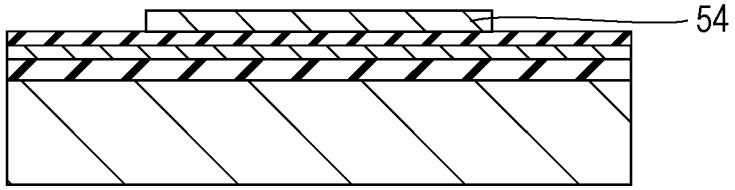
Figure 4D:
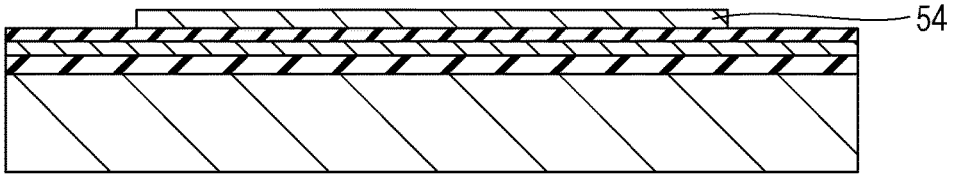

Subsequently, as shown in FIGS. 3D and 4D, a sacrificial layer 54 is formed. The sacrificial layer 54 should be made of a material having a low surface roughness. In addition, in order to shorten the etching time for removing the sacrificial layer, the sacrificial layer should be made of a material having a high etching rate. Furthermore, the sacrificial layer is required to be made of a material such that the second insulating film, the first membrane, and the second electrode are hardly etched by the etching solution or etching gas for removing the sacrificial layer. If the second insulating film, the first membrane, and the second electrode are etched by the etching solution or etching gas for removing the sacrificial layer, the thickness of the vibration film varies to cause a variation in the distance between the first electrode and the second electrode. When the second insulating film and the first membrane are silicon nitride films or silicon oxide films, the sacrificial layer may be made of chromium.

Figure 3E:
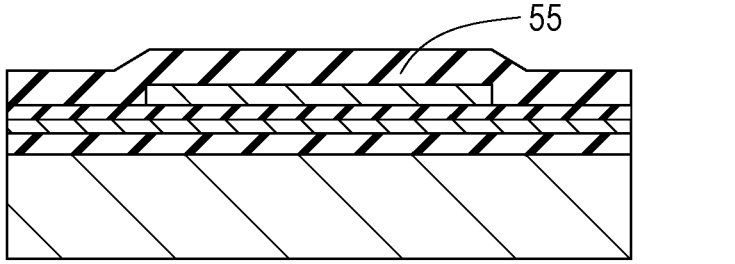
Figure 4E:
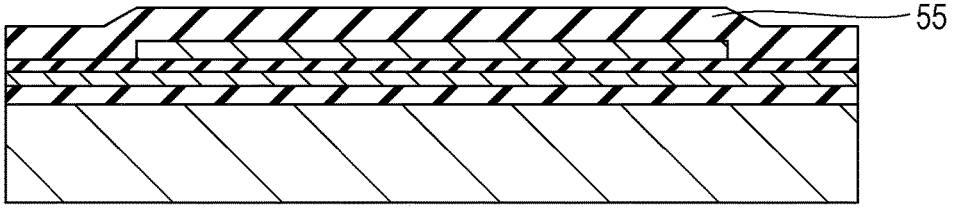

Subsequently, as shown in FIGS. 3E and 4E, a first membrane 55 is formed on the sacrificial layer 54. A membrane-supporting portion is also formed in this step. The first membrane 55 is required to have a low tensile stress, for example, a tensile stress of higher than 0 MPa and 300 MPa or less. A silicon nitride film may control its stress and may have a low tensile stress of 300 MPa or less. If the first membrane 55 has a compression stress, the first membrane causes sticking or buckling and is thereby largely deformed. The sticking is a phenomenon where the first membrane 55 adheres to the first electrode side. If the tensile stress is high, the first membrane may be broken. Accordingly, the first membrane 55 should have a low tensile stress.

Figure 3F:
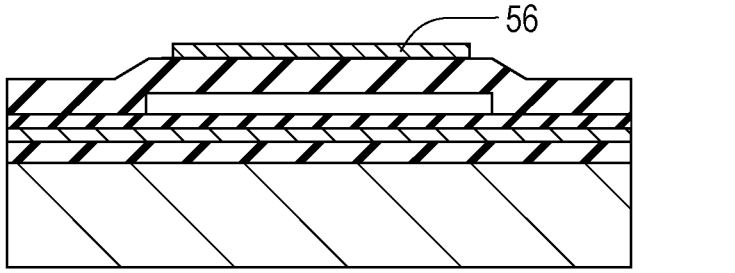
Figure 4F:
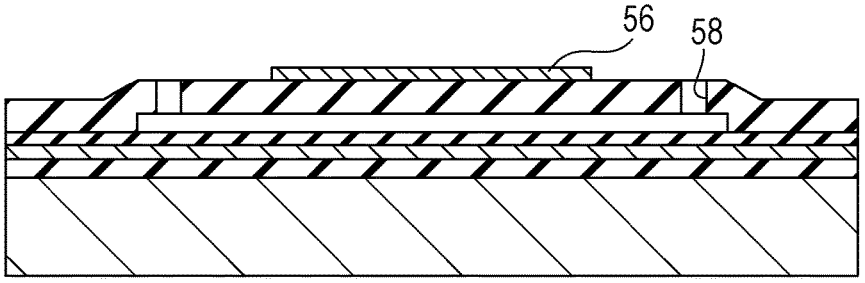

Subsequently, as shown in FIGS. 3F and 4F, a second electrode 56 is formed on the first membrane, and, as shown in FIG. 4F, etching-holes 58 are formed. Subsequently, the sacrificial layer 54 is removed through the etching-holes.

The second electrode 56 is required to be made of a material having a low residual stress, high heat resistance, and etching resistance against the etching of the sacrificial layer. If the etching resistance is low, the sacrificial layer is required to be removed by etching with, for example, a photoresist applied for protecting the second electrode. However, in the case of using the photoresist or the like, the membrane tends to cause sticking due to the stress of the photoresist or the like. Accordingly, the second electrode 56 should be made of a material having etching resistance so that the sacrificial layer may be etched in the state that the second electrode 56 is exposed without using photoresist or the like.

Figure 3G:
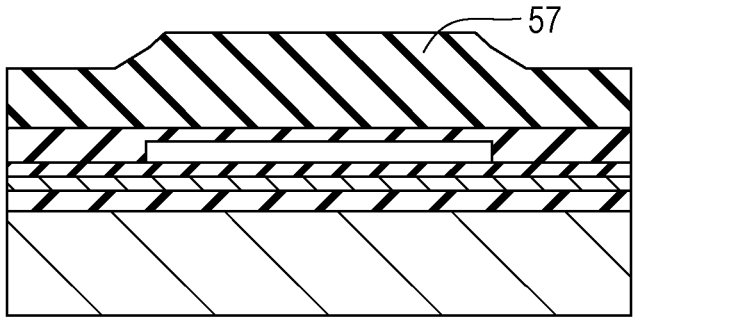
Figure 4G:
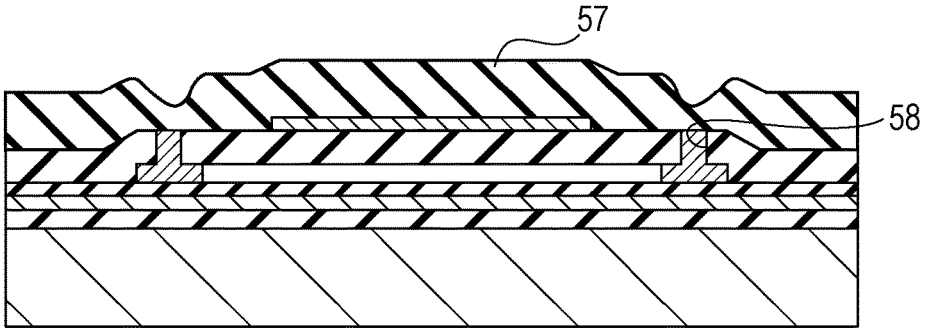

In addition, if the second electrode has a high residual stress, the vibration film is largely deformed. Accordingly, the second electrode is required to have a low residual stress. Furthermore, as shown in FIGS. 3G and 4G, the second electrode is required to be made of a material that is not deteriorated or does not increase its stress by the temperature and other factors for forming the second membrane. The second electrode may be made of titanium.

Subsequently, as shown in FIGS. 3G and 4G, formation of a second membrane 57 and sealing of the etching-holes 58 are simultaneously performed. In this step, as shown in FIG. 4G, the step of forming the second membrane 57 and the step of sealing of the etching-holes 58 are performed in the same step. That is, in this step, the second membrane 57 is formed on the second electrode (on the surface of the second electrode on the opposite side of the cavity), and thereby a vibration film having a predetermined spring constant may be formed, and also a sealing portion that seals the etching-holes may be formed.

In the case where the step of sealing the etching-holes 58 is performed after the step of forming the second membrane 57, a film for sealing the etching-holes 58 is deposited on the second membrane 57. Etching for removing this deposited film causes variations in thickness and stress of the vibration film. On the other hand, in the step of one embodiment, the step of sealing the etching-holes 58 and the step of forming the second membrane 57 are the same, and thereby the vibration film may be formed only through film-forming steps. That is, in the present invention, the film formed on the second electrode is not removed by, for example, etching, and thereby variations in thickness and stress of the vibration film hardly occur.

After this step, wiring that is connected to the first electrode and the second electrode is formed (not shown). The material of the wiring may be, for example, aluminum.

As described above, in the electromechanical transducer produced by this method, the membrane having a predetermined spring constant may be formed only by film-forming steps without etching the film serving as the second membrane. Accordingly, the variations in thickness and stress of the vibration film of the electromechanical transducer may be reduced, and thereby variations in sensitivity and bandwidth of the electromechanical transducer may be reduced.

In FIG. 1C, in the electromechanical transducer produced according to this embodiment, the thickness of the sealing portion sealing the etching-holes 19 is the same as that of the second membrane 18 on the second electrode 4. Throughout the specification, the thickness of the sealing portion is the thickness of the central portion of an etching-hole in the direction perpendicular to the surface on which the first electrode is formed, and is the thickness indicated by the arrow 5 in FIG. 1C. The phrase "the thickness of the sealing portion is the same as that of the second membrane 18 on the second electrode 4" is not limited to the case of "the thicknesses are strictly the same", and "the case where a difference in thickness is within the range of variation in film formation" is also included in "the case where the thicknesses are the same". Specifically, the difference in thickness within the range of variation in film formation is that the thickness of the sealing portion is ±10% of the thickness of the second membrane 18 on the second electrode 4.

A Preferred Embodiment

A preferred embodiment will be described. In this embodiment, the first membrane 55 has a thickness twice or more that of the sacrificial layer 54. If the thickness of the first membrane 55 is less than twice that of the sacrificial layer 54, the first membrane 55 may not satisfactorily cover the stepped portion of the sacrificial layer. In particular, if the covering state of the corner of the side surface and the upper surface of the sacrificial layer 54 is bad, a variation in mechanical characteristics of the first membrane 55 occurs among the cells or the elements when the cavity is formed by etching the sacrificial layer.

Accordingly, the first membrane 55 is formed so as to have a thickness (the thickness indicated by the arrow 7 in FIG. 1B) twice or more the thickness (the thickness indicated by the arrow 9 in FIG. 1B) of the sacrificial layer 54, and thereby the first membrane 55 may satisfactorily cover the stepped portion of the sacrificial layer 54. Consequently, the variation among the cells or the elements in mechanical characteristics of the first membrane 55 may be reduced. In the electromechanical transducer produced in this configuration shown in FIG. 1B, the thickness of the first membrane 16 is twice or more the depth of the cavity 3. Throughout the specification, the term "thickness" of, for example, the first membrane 16 refers to the thickness in the direction perpendicular to the surface on which the first electrode is formed. The term "depth" of the cavity 3 refers to the distance of the space from the second insulating film 14 to the first membrane 16 in the state where no voltage is applied between the electrodes.

The second membrane 57 on the second electrode 4 may be formed so as to have a thickness (the thickness indicated by the arrow 8 in FIG. 1B) triple or more the depth (the thickness indicated by the arrow 9 in FIG. 1B) of the cavity. If the thickness of the second membrane 57 is less than triple the depth of the cavity, the insulating film serving as the second membrane 57 may not satisfactorily close the etching-holes 58 and thereby may not satisfactorily seal the cavity. Accordingly, the thickness of the second membrane 57 is adjusted to be triple or more the depth of the cavity, and thereby the insulating film serving as the second membrane 57 may close the etching-holes 58 and may satisfactorily seal the cavity. In the electromechanical transducer shown in FIGS. 1A to 1C produced with this configuration, the thickness of the second membrane 18 is triple or more the depth of the cavity 3.

Furthermore, the second membrane 57 may be formed so as to have a larger thickness than that of the first membrane 55. The distance between the electrodes may be reduced by decreasing the thickness of the first membrane 55. The spring constant of a vibration film varies depending on the thickness of the vibration film. Accordingly, the spring constant may be easily adjusted to a predetermined level while maintaining a small thickness of the first membrane 55 by adjusting the total thickness of the vibration film through control of the thickness of the second membrane 57. As shown in FIG. 1B, in the electromechanical transducer produced with this configuration, the second membrane 18 has a larger thickness than that of the first membrane 16.

Figure 2A:
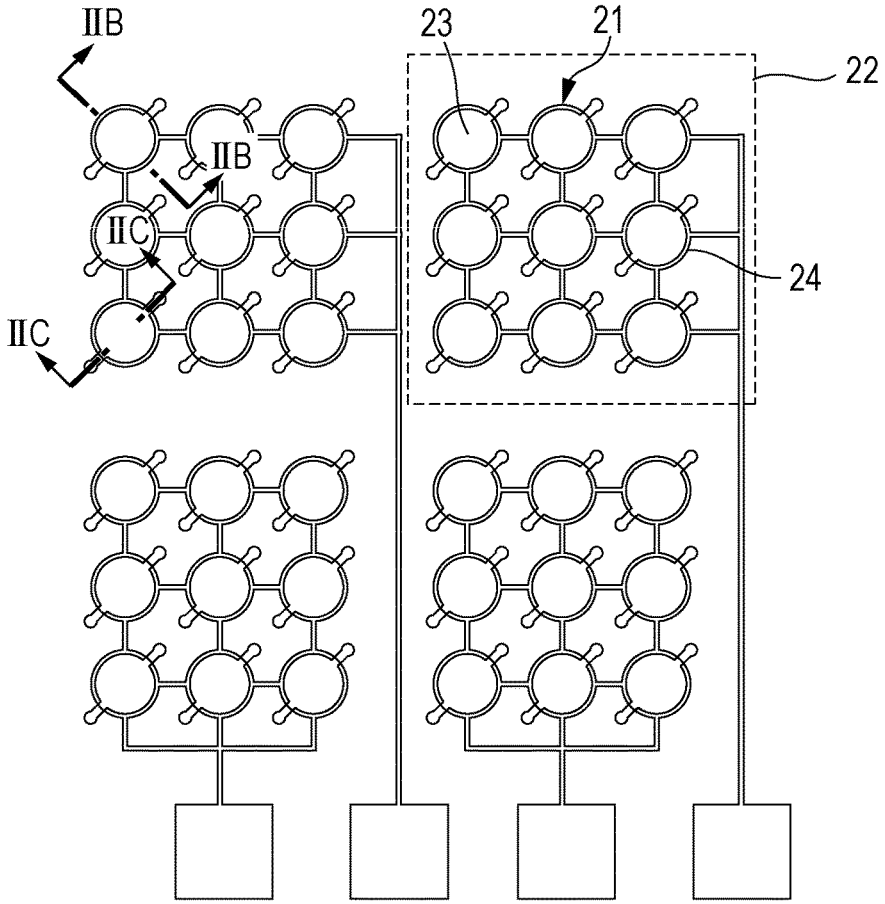
FIGS. 2A to 2C are schematic diagrams illustrating an electromechanical transducer to which Example 2 according to aspects of one embodiment may be applied.
Figure 2B:
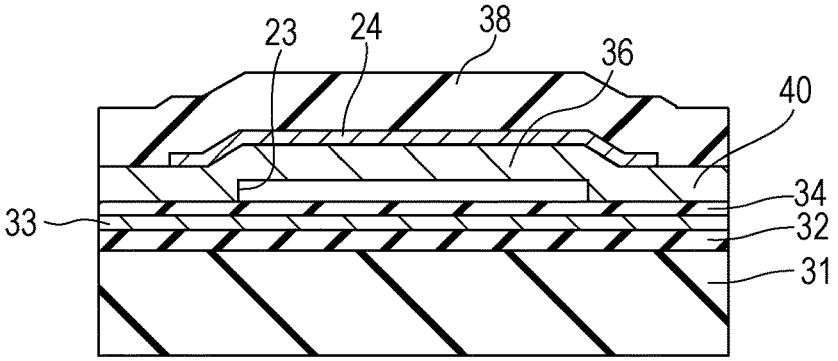

The second electrode may be formed so as to cover the entire surface of the sacrificial layer (see Example 2 described below). If misalignment occurs in photolithography for forming the second electrode, the central axis of the sacrificial layer (i.e., the central axis of the cavity) and the central axis of the second electrode may deviate from each other. If the area of the second electrode is smaller than the area of the cavity and the central axis of the cavity and the central axis of the second electrode deviate from each other, the stress of the second electrode acting on the first membrane varies, which may cause a variation among the cells or the elements in bending of the vibration film. Accordingly, a second electrode is formed so as to cover the entire surface of the sacrificial layer, and thereby the variation in bending of the vibration film due to the misalignment in photolithography for forming the second electrode may be reduced. As shown in FIG. 2B, in the electromechanical transducer produced with this configuration, the second electrode 24 is formed so as to have an area larger than that of the cavity 23 and to cover the entire of the cavity 23. In particular, the distance from the central axis to the outer boundary of the second electrode 24 is required to be larger than the distance from the central axis to the outer boundary of the cavity 23 by about 3 μm to prevent an increase in parasitic capacitance (capacitance where the electrostatic capacitance does not change when the vibration film vibrates) that occurs between the second electrode and the first electrode.

The second electrode 56 may be made of titanium. Titanium has a low residual stress and may therefore prevent the vibration film from being largely deformed. In the case where the first membrane 55 and the second membrane 57 are silicon nitride films, the Young's modulus of the second electrode 56 is lower than those of the first membrane 55 and the second membrane 57. Accordingly, a vibration film having a predetermined spring constant may be easily formed by controlling the thickness of the second membrane 57. Titanium has high heat-resistance and may therefore prevent deterioration due to high temperature when the second membrane is formed. In addition, titanium may reduce surface roughness and may therefore prevent the variation in bending of the membrane.

The first membrane 55 may be made of silicon nitride. In silicon nitride, the stress may be easily controlled, and the first membrane 55 may be therefore formed at a low tensile stress of, for example, higher than 0 MPa and not higher than 300 MPa. Consequently, the vibration film may be prevented from being largely deformed by the residual stress of the silicon nitride film. The silicon nitride film may be formed at a low temperature (200 to 400° C.) by plasma enhanced chemical vapor deposition (PE-CVD) compared with low pressure chemical vapor deposition (LPCVD). The Young's modulus of a silicon nitride film formed by PE-CVD may be 180 GPa or more, and therefore the stiffness of the first membrane may be increased.

The first membrane 55 may be formed so as to have a spring constant of 500 N/m or more and 3000 N/m or less. Throughout the specification, the spring constant (k) is calculated from the maximum displacement (x) when a uniformly distributed load (F) is applied to the entire vibration film by the expression: $k=F/x$. For example, when a uniformly distributed load of 10 μN is applied and the maximum displacement is 10 nm, the spring constant is 1000 N/m.

An increase in spring constant of the first membrane 55 causes an increase in stiffness and also an increase in thickness of the first membrane 55. An increase in thickness of the first membrane 55 increases the distance between the first electrode 52 and the second electrode 56, resulting in a decrease in conversion efficiency. The conversion efficiency herein is the efficiency of converting vibration of a vibration film into an electrical signal. The conversion efficiency is increased with a decrease in the distance between the first electrode 52 and the second electrode 56. If the first membrane 55 has a low spring constant, after etching of the sacrificial layer 54, adhesion of the first membrane 55 to the first electrode side occurs (sticking).

The sticking occurs by, for example, the residual stress of the first membrane 55 or the second membrane 57, surface tension due to water evaporation during etching of the sacrificial layer, electrostatic force, or moisture absorption due to hydroxyl groups on the surface. In particular, in the case of performing etching of the sacrificial layer by wet etching, sticking tends to occur. In particular, in an electromechanical transducer of which the vibration film has a vibration frequency bandwidth of 0.3 to 20 MHz, the cavity depth is 50 to 300 nm, and sticking tends to occur. Accordingly, the first membrane 55 is formed so as to have a spring constant of 500 N/m or more and 3000 N/m or less, and thereby the decrease in conversion efficiency may be prevented and sticking may be avoided.

EXAMPLES

The embodiments will be described in detail by using more specific examples.

Example 1

Example 1 according to aspects of one embodiment will be described with reference to FIGS. 1A to 1C, 3A to 3G, and 4A to 4G. An electromechanical transducer of this Example will be described with reference to FIGS. 1A to 1C, and then a method of producing the electromechanical transducer will be described with reference to FIGS. 3A to 3G and 4A to 4G. FIG. 1A is a top view illustrating an electromechanical transducer according to aspects of the present invention, and FIGS. 1B and 1C are cross-sectional views taken along lines IB-IB and IC-IC, respectively, of FIG. 1A. The electromechanical transducer of this Example includes four elements 2 each including nine cell structures 1.

A cell structure 1 includes a silicon substrate 11 having a thickness of 300 μm, a first insulating film 12 disposed on the silicon substrate 11, a first electrode 13 disposed on the first insulating film 12, and a second insulating film 14 on the first electrode 13. The cell structure 1 further includes a vibration film composed of a first membrane 16 disposed on the second insulating film 14 with a space therebetween, a second membrane 18, and a second electrode 4. The first membrane 16 is supported by a membrane-supporting portion 20. The thickness of a sealing portion sealing etching-holes 19 is the same as the thickness of the second membrane 18 on the second electrode 4. Accordingly, the vibration film having a predetermined spring constant may be formed only by film forming steps, without etching the film serving as the second membrane 18.

The first insulating film 12 is a silicon oxide film having a thickness of 1 μm formed by thermal oxidation. The second insulating film 14 is a silicon oxide film formed by PE-CVD. The first electrode 13 and second electrode 4 are made of titanium and have thicknesses of 50 nm and 100 nm, respectively. The first membrane 15 and the second membrane 18 are silicon nitride films each having a tensile stress of 100 MPa or less formed by PE-CVD.

The first membrane 16 and the second membrane 18 each have a diameter of 45 μm and have thicknesses of 0.4 μm and 0.7 μm, respectively. The second electrode 4 has a diameter of 40 μm. The cavity has a depth of 0.18 μm. The first membrane 16 has a spring constant of 1200 N/m, and thereby the first membrane after formation of the cavity 3 is prevented from sticking.

In this Example, the first membrane 16 has a thickness twice or more the depth of the cavity and thereby may satisfactorily cover the stepped portion due to the formation of the cavity.

The second membrane 18 has a thickness of triple or more the depth of the cavity 3. By doing so, the insulating film serving as the second membrane 18 may close the etching-holes 19 and thereby may satisfactorily seal the cavity 3. The thickness of the first membrane 16 is smaller than that of the second membrane 18. Accordingly, the spring constant of the membranes may be easily adjusted to a predetermined value by controlling the thickness of the second membrane 18. The electromechanical transducer of this Example may extract an electrical signal from the second electrode 4 of each element separately by using lead wiring 6.

A method of producing the electromechanical transducer of this Example will be described with reference to FIGS. 3A to 3G and 4A to 4G. FIGS. 3A to 3G are cross-sectional views taken along line III-III of FIG. 1A, and FIGS. 4A to 4G are cross-sectional views taken along line IV-IV of FIG. 1A.

As shown in FIGS. 3A and 4A, a first insulating film 51 is formed on a substrate 50. The substrate 50 is a silicon substrate having a thickness of 300 μm. The first insulating film 51 is a silicon oxide film having a thickness of 1 μm formed by thermal oxidation for providing insulation between the first electrode 52 and the substrate 50.

Subsequently, as shown in FIGS. 3B and 4B, a first electrode 52 is formed. The first electrode 52 is made of titanium and has a thickness of 50 nm and a root mean surface roughness (Rms) of 2 nm or less.

Subsequently, as shown in FIGS. 3C and 4C, a second insulating film 53 is formed. The second insulating film 53 is a silicon oxide film formed by PE-CVD so as to have a thickness of 0.1 μm and a root mean surface roughness (Rms) of 2 nm or less. The second insulating film 53 is formed for preventing electrical short between the first electrode 52 and the second electrode 56 or breakdown when a voltage is applied between the first electrode 52 and the second electrode 56.

Subsequently, as shown in FIGS. 3D and 4D, a sacrificial layer 54 is formed. The sacrificial layer 54 is made of chromium and has a thickness of 0.2 μm and a root mean surface roughness (Rms) of 1.5 nm or less. The diameter of the sacrificial layer 54 is 40 μm.

Subsequently, as shown in FIGS. 3E and 4E, a first membrane 55 is formed. The first membrane 55 is a nitride film having a thickness of 0.4 μm formed by PECVD. The first membrane 55 has a residual stress of 200 MPa.

Subsequently, as shown in FIGS. 3F and 4F, a second electrode 56 is formed, and etching-holes 58 are further formed in the first membrane. The second electrode 56 is made of titanium and has a thickness of 0.1 μm and a residual stress of 200 MPa or less. Titanium does not cause an increase in the surface roughness and a change in the stress by the temperature when a second membrane 57 is formed as shown in FIGS. 3G and 4G. In addition, titanium is not etched when the sacrificial layer 54 is removed, and thereby the sacrificial layer 54 may be removed without protecting the second electrode 56 with a resist, for example.

Subsequently, the sacrificial layer 54 is removed through the etching-holes 58. The sacrificial layer 54 is removed using a chromium etchant (mixed acid of cerium ammonium nitrate, perchloric acid, and water). In particular, the first membrane 55 tends to adhere to the first electrode 52 side due to the drying step after removal of the sacrificial layer 54. However, the first membrane 55 has a spring constant of 1250 N/m, which allows formation of the cavity while inhibiting sticking. In addition, since the chromium etchant does not etch silicon nitride, titanium, and silicon oxide films, the variation in thickness of the vibration film and the variation in distance between the first electrode and the second electrode may be prevented.

Subsequently, as shown in FIGS. 3G and 4G, the second membrane 57 is formed and also the etching-holes 58 are sealed. Since the etching-holes are sealed in the step of forming the second membrane 57, the vibration film may be formed without being etched.

In the method of producing the electromechanical transducer of this Example, the membranes having a predetermined spring constant may be formed only by the film forming steps. Consequently, an electromechanical transducer in which the variations among the cells or the elements in sensitivity and bandwidth are reduced may be produced. In the electromechanical transducer produced by such a method, the variation among the elements in sensitivity may be reduced to 1 dB or less.

Example 2

Figure 2C:
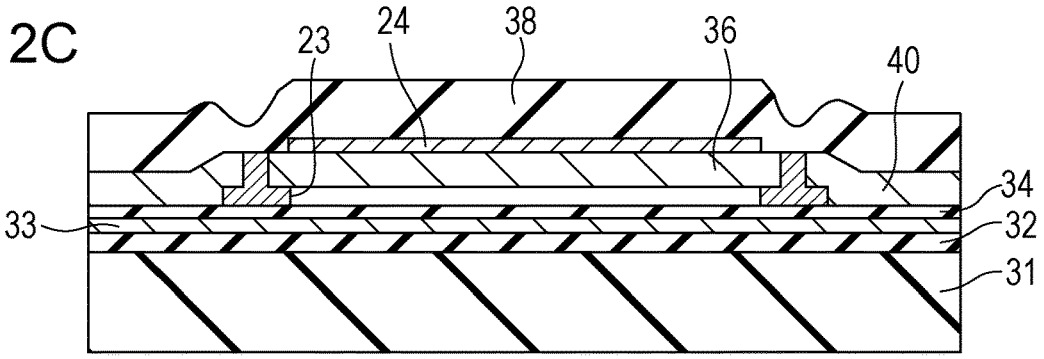

Example 2 according to aspects of one embodiment will be described with reference to FIGS. 2A to 2C. FIG. 2A is a top view illustrating the electromechanical transducer according to this Example, and FIGS. 2B and 2C are cross-sectional views taken along lines IIB-IIB and IIC-IIC, respectively, of FIG. 2A. The configuration of the electromechanical transducer of Example 2 is the same as that of Example 1 except that the area of the second electrode 24 is characteristic.

The cell structure 21 includes a silicon substrate 31 having a thickness of 300 μm, a first insulating film 32 disposed on the silicon substrate 31, a first electrode 33 disposed on the first insulating film 32, and a second insulating film 34 on the first electrode 33. The cell structure 21 further includes a vibration film composed of a first membrane 36 disposed on the second insulating film 34 with a cavity 23 therebetween, a second membrane 38, and a second electrode 24; and a membrane-supporting portion 40 for supporting the first membrane 36. The element 22 is composed of a plurality of the cell structures 21 electrically connected to one another.

The first insulating film 32 is a silicon oxide film having a thickness of 1 μm formed by thermal oxidation. The second insulating film 34 is a silicon oxide film having a thickness of 0.1 μm formed by PE-CVD. The first electrode 33 and second electrode 24 are made of titanium and have thicknesses of 50 nm and 100 nm, respectively. The first membrane 36 and the second membrane 38 are silicon nitride films each having a tensile stress of 200 MPa or less formed by PE-CVD. The first membrane 36 and the second membrane 38 each have a diameter of 50 μm and have thicknesses of 0.4 μm and 0.7 μm, respectively. The second electrode 24 has a diameter of 56 μm. The cavity has a depth of 0.2 μm.

In this Example, the second electrode 24 has a larger diameter than those of the first membrane 36 and the second membrane 38, and the second electrode covers the cavity. In this configuration, the variation in bending of the vibration film may be reduced even if misalignment is caused by photolithography for forming the second electrode.

In the electromechanical transducer having the configuration of this Example described above, membranes having a predetermined spring constant may be formed only by film-forming steps. Furthermore, the variation in bending of the vibration film may be reduced even if misalignment is caused by photolithography for forming the second electrode, and thereby the variation among elements in sensitivity may be reduced to 0.5 dB or less.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A cell structure comprising:

a first electrode;

an insulating film disposed on the first electrode;

a vibration film including a first membrane disposed on the insulating film with a space therebetween, a second electrode disposed on the first membrane so as to oppose the first electrode, and a second membrane disposed on the second electrode and the first membrane;

and a sealing portion, which seals an etching-hole through the first membrane to the space, has a thickness equal to a thickness, within a range of variation of 10%, of the second membrane on the second electrode, wherein the first membrane has a thickness twice or more that of the space, wherein the second membrane has a thickness triple or more that of the space, and wherein the second membrane is thicker than the first membrane.

2. The cell structure according to claim 1, wherein the second membrane has a larger thickness than that of the first membrane.

3. The cell structure according to claim 1, wherein the first membrane has a spring constant of 500 N/m or more and 3000 N/m or less.

4. The cell structure according to claim 1, wherein the second electrode covers an entire surface of the space.

5. The cell structure according to claim 1, wherein the second electrode has a Young's modulus lower than that of the first membrane or the second membrane.

6. An electromechanical transducer comprising:

a plurality of elements each comprising a plurality of cell structures, each of the plurality of cell structures comprising:

a first electrode, an insulating film disposed on the first electrode, a vibration film including a first membrane disposed on the insulating film with a space therebetween, a second electrode disposed on the first membrane so as to oppose the first electrode, and a second membrane disposed on the second electrode and the first membrane, and a sealing portion, which seals an etching-hole through the first membrane to the space, has a thickness equal to a thickness, within a range of variation of 10%, of the second membrane on the second electrode, wherein the first membrane has a thickness twice or more that of the space, wherein the second membrane has a thickness triple or more that of the space, and wherein the second membrane is thicker than the first membrane, and a plurality of wirings each connecting a subset of the plurality of elements to extract an electrical signal from one of the first and second electrodes in one of the plurality of cell structures.

7. The electromechanical transducer according to claim 6, wherein the second membrane has a larger thickness than that of the first membrane.

8. The electromechanical transducer according to claim 6, wherein the first membrane has a spring constant of 500 N/m or more and 3000 N/m or less.

9. The electromechanical transducer according to claim 6, wherein the second electrode covers an entire surface of the space.

10. The electromechanical transducer according to claim 6, wherein the second electrode has a Young's modulus lower than that of the first membrane or the second membrane.

* * * * *